United States Patent [19]

Addison

[11] 4,261,544

[45] Apr. 14, 1981

[54] ELEMENT LOCATOR FOR CONCRETE

[76] Inventor: Elvin R. Addison, 2000 W. 92nd Ave., #63, Denver, Colo. 80221

[21] Appl. No.: 19,422

[22] Filed: Mar. 12, 1979

[51] Int. Cl.[3] ..... E04G 17/00

[52] U.S. Cl. ..... 249/207; 249/93; 269/287

[58] Field of Search ..... 249/48, 93, 95, 205, 249/249; 269/287

[56] References Cited

U.S. PATENT DOCUMENTS

| | | | |
|---|---|---|---|
| 975,242 | 11/1910 | Higgins et al. | 249/48 |
| 1,199,077 | 9/1916 | James | 249/210 |
| 1,382,082 | 6/1921 | Heltzel | 249/205 |
| 1,643,578 | 9/1927 | Eaton et al. | 249/205 |
| 2,301,306 | 11/1942 | McDonald | 249/207 |
| 2,804,673 | 9/1957 | Fex | 249/210 |
| 3,219,308 | 11/1965 | Halstead | 249/48 |
| 3,376,010 | 4/1968 | Myer | 249/207 |
| 3,912,218 | 10/1975 | Lister | 249/93 |
| 3,960,356 | 6/1976 | Adams | 249/205 |
| 3,963,210 | 6/1976 | Macklin | 249/93 |

FOREIGN PATENT DOCUMENTS

| | | | |
|---|---|---|---|
| 474047 | 8/1952 | Italy | 249/48 |
| 1407699 | 9/1975 | United Kingdom | 249/205 |

*Primary Examiner*—Jay H. Woo

*Attorney, Agent, or Firm*—Donald W. Margolis; H. Kenneth Johnston, II

[57] ABSTRACT

This is a universal, re-usable system to accurately locate and temporarily hold an element to-be-embedded in concrete in a form. The system includes at least two rails and at least one element locating plate. The plate is capable of being attached in combination with and supported by the rails at any point along their length, while the rails supporting the plate are capable of being located at any position on a concrete form, so that an element locating plate and the related work element are capable of being accurately positioned at any location within the form. In preferred embodiments the to-be-located element is an anchor bolt and the plate defines at least one opening of a size which allows the bolt to be inserted through the plate.

19 Claims, 3 Drawing Figures

ELEMENT LOCATOR FOR CONCRETE

BACKGROUND OF THE INVENTION

1. Field of the Invention

The present invention relates to systems which provide, during the in situ pouring of concrete, work holders for the accurate location of elements to-be-embedded in concrete. More specifically, it relates to a reusable system including at least two rails and at least one element locating plate which is attached to and supported by the rails to accurately locate the plate at any location within a concrete form.

2. Description of the Prior Art

In many types of construction operation utilizing concrete, it is necessary or desireable to locate a work element, such as an anchor bolt, in the concrete. The accuracy required in the location of the work element varies from job to job. Many construction jobs require the precise positioning of work elements, both as to their specific location within the concrete, and also with respect to their location to other work elements. It has been common practice in the art, where precise location of one or more element in concrete is required, to rig a template, for example of plywood, boards, or other building materials, then to precisely drill or cut holes in the template which correspond as nearly as possible to the desired location of each work element, secure each work element to the large template, place the entire template and the work elements which it carries over a concrete form, secure it for example by nailing it to the form, and then pour concrete into the form. Such systems have their limitations. Several problems arise when the concrete is poured. For example, during the pouring of concrete to secure anchor bolts, the bolts often tend to rotate, gradually rising or sinking in the concrete, thus eventually being set at the wrong level. Additionally, the force, pressure, and weight of the concrete often tends to skew bolts out of the vertical and it is usually impossible, once all the concrete has been poured, to straighten the bolts by twisting the small portion which remains above the concrete surface. Additionally, such large wooden templates often make it difficult, or impossible to properly finish the top surface of the concrete. Furthermore, such prior art templates require a great deal of time and material to produce, are large and cumbersome to work with, and normally have utility for but a single concrete job. Seldom in any two pours is the pattern and size of work elements to-be-located in the concrete duplicated. Thus, these prior art templates have utility for only one pour and their normal disposition has been to the scrap heap after one use.

Such systems have been especially needed where anchor bolts embedded in concrete are used to support and secure structures, including buildings bridges, and machinery. In such applications, it is important that the anchor bolts be previously and accurately cast into concrete to accept, secure, and support the structure or device. Failure to locate the bolts accurately both with respect to one another, or with respect to the entire concrete surface, makes it difficult to seat and secure equipment or steel having premachined openings. As already noted, accurate location of bolts, for such purposes, has in the past required a great deal of time and has been relatively expensive in terms of the types of materials which have been utilized, the labor required to produce them, and the lack of reusability of the template.

Efforts have been made to provide smaller or reusable locating means for elements to be located in concrete. For example, U.S. Pat. No. 1,199,077 provides means for locating an anchoring element within concrete. However, the locating means taught in that reference remains in the concrete and is not reusable. U.S. Pat. No. 3,304,079 discloses a complex mechanical system for holding bolts during concrete formation. U.S. Pat. No. 3,468,184 discloses a collapsible cardboard system for use in positioning and aligning anchor bolts in concrete. However, such positioners require individual machining to locate each element. U.S. Pat. Nos. 3,150,429 and 3,552,734 are of interest as disclosing means for locating anchor bolts around the periphery of a concrete pour, while U.S. Pat. No. 3,912,218 discloses a method of locating bolts for hand rails at the edges of stairs. However, none of these systems discloses an inexpensive, non-consumed, reusable, universal locating system for anchor bolts or other work elements, which system is capable of locating elements accurately at any location within a pour.

U.S. Pat. No. 3,219,308 is of interest as disclosing a complex system for locating forms in concrete piers or columns. However, it does not provide for precise anchor bolt location. Anchor bolt location is accomplished by means such as a transit or level. U.S. Pat. No. 3,960,356 is of particular interest as disclosing a system which allows a great deal of discretion in the size and shape of elements to-be-located at almost any location. Unfortunately, by its nature, it is limited to small forms, and does not provide for accurate location of more than one element with respect to another element.

In order for a system to provide anchor bolt location, while overcoming the problems of the prior art, it must be relatively small, portable, light weight, and substantially capable of accepting almost any size and shape of element to be located in concrete. It should also be capable of locating such elements securely so that they neither drift, change elevation, nor tilt. It should also be capable of being reused. Additionally, it should be easily stored in a small space, readily set up at a building site to precisely locate the elements at their required positions and spaces during the concrete pouring and setting operations, and it should thereafter be readily disengageable from the element and easily disassemblable for storage until needed again.

BRIEF DESCRIPTION OF THE PRESENT INVENTION

The present invention consists, very simply, of at a minimum, two rails and at least one small element locating plate. The relationship between the rails and the plate is such that the plate can be attached in combination with and supported by the two rails at any position along their length and the whole structure accurately positioned on a form, so that the plate is located precisely where the work element is to be located.

This system is relatively small, portable, light weight, simple in form, and readily and easily installed by a single worker, by hand without a need for special tools or equipment. As such, it provides a positioning device adapted to support an anchor bolt or other element within a form into which concrete is to be poured. The elements of the device are simple and economical to manufacture. Furthermore, the system is practical, reliable, and durable, as well as being effective for the purpose for which it is designed. It is capable of accomodating virtually any size or shape element to-be-embedded in the concrete. It is also capable of accomodating varying sized elements in a single system. Also a single system, or a number of systems can accomodate virtually any number of elements at almost any location in a form, all at the same time. It can also be used to precisely locate a plurality of elements in a row by positioning a number of element locating plates in combination with a single pair of rails. This allows the correct positioning and spacing of a plurality of bolts with respect to one another along the pair of rails.

The elements of the system are universal, in that they may be changed to any configuration or size required during any concrete pour and adjusted to accomodate any element or design. The system allows the control of the amount of insertion of the work element into or above concrete, as the case may be. Because of its small size, and relatively light weight, it may be easily assembled, taken apart after use, stored, easily reassembled, or shipped from place to place after use, as the conditions require.

When its use is required, it may be assembled with high precision by even inexperienced workmen in a short period of time, and generally, without the need for special tools or equipment. Because of its small size, it leaves a great deal of space between and around the work element in which to pour concrete, and also to allow for finishing of the concrete surface after it is poured. It is rugged and may be aligned in any direction and easily secured using readily available carpatners rule, hammer, nails, string, or transit instruments. Where desired, both the rails and/or the plates may be ruled for measurement, alignment, centering, or other precision uses. The present invention requires no special grid or measuring frame to accurately locate the element locating plates. It is capable of easy disassembly, cleaning, and storage after use. There is virtually no limit to the number of times which the system of the present invention may be used and reused.

BRIEF DESCRIPTION OF THE DRAWINGS

The various objects and features of the present invention will be more fully understood from the following detailed description of preferred embodiments and applications thereof, throughout which reference is made to the accompanying drawings in which.

DETAILED DESCRIPTION OF THE INVENTION

Figure 1:
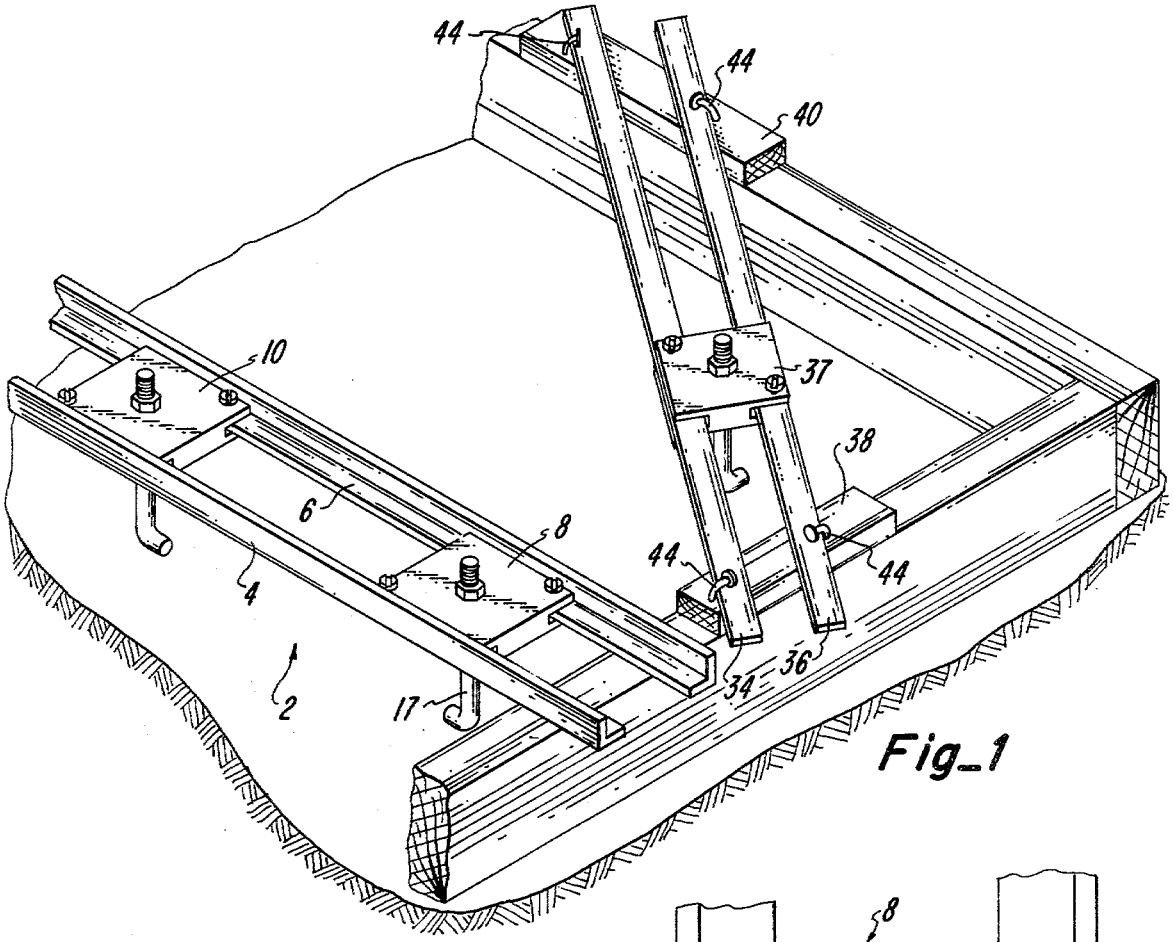
FIG. 1 shows, in perspective view, several types of locators in accordance with the present invention and a portion of a concrete form with which they may be used.

Referring to the drawings, the element locating systems of the present invention are quite simple and adaptable for use in locating virtually any type of work element at a precisely predetermined position within a concrete form prior to the pouring of concrete.

Figure 3:
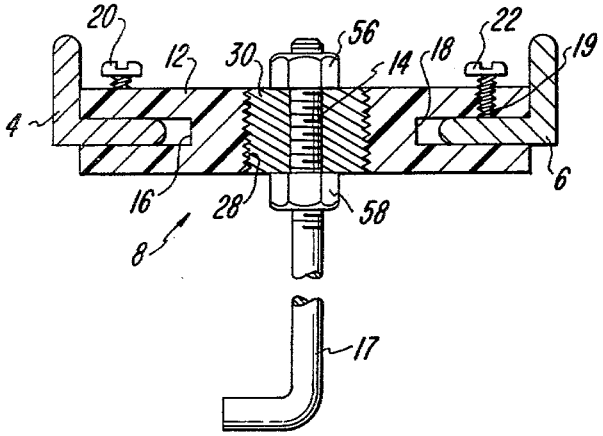
FIG. 3 is a cross-sectional view taken along a line 3—3 of FIG. 2.

Locator system 2 consists of a pair of rails 4 and 6. In this embodiment, for reasons of strength, each of the rails is preferably in the form of an angle iron. Locating plates 8 and 10 are attached to and supported by both railings 4 and 6 at predetermined locations, as described below. Now, referring to FIGS. 2 and 3 for more detail, locating plate 8 consists of substantially rigid plate element 12 carrying at least one opening 14 of a predetermined or adjusted size and shape to securely hold and support an element, such as anchor bolt 17, to-be-embedded in concrete. In this embodiment, plate 12 includes a pair of parallel sides carrying slots 16 and 18 extending along parallel opposed side portions of plate 12. In this preferred embodiment, extending from the top of plate 12 in to each of slots 16 and 18, are screw openings, screw opening 19 being shown in FIG. 3, through which screws 20 and 22, respectively, are threaded. Screws 20 and 22 are preferably of the self tapping type, and preferably of a configuration which will not collect substantial amounts of concrete.

As shown, one leg or flange of each rail 4 and 6 extends in combination into slots 16 and 18, respectively. In preferred embodiments, plate 8 is secured in place and to the rails at the desired location by means of screws 20 and 22. In this manner, plate 8 and any element carried by plate 8 can be located and secured at virtually any predetermined location within a form.

As shown in FIG. 1, more than one element can be located utilizing a single set of rails and a plurality of locating plates. In this illustration, second plate 10 of the same width as plate 8 is secured to rails 4 and 6 at a predetermined distance from locating plate 8. This feature of the present invention allows a single pair of rails to locate a plurality of work elements in linear relation to one another along the rails. Since each locating plate may carry a different size or shape work element, without the need to vary the distance between rails 4 and 6, the system of the present invention provides a great deal of flexibility in locating different sized and shaped elements in linear relation to one another. Where a nonlinear relation between elements is required, a plurality of the locating systems of the present invention may be utilized as illustrated in FIG. 1.

Figure 2:
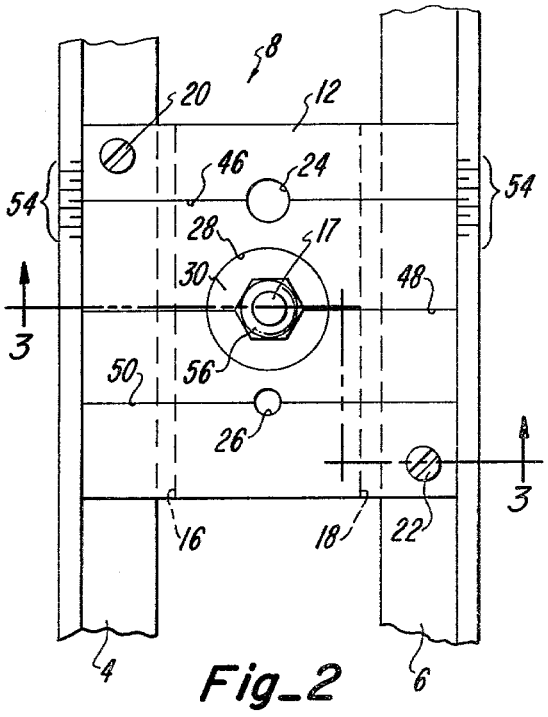
FIG. 2 is an enlarged plan view of one modified form of one of the locating plates shown in FIG. 1.

Referring to FIG. 2, several alternative embodiments of the present invention are shown. In this embodiment, locator plate 8 carries additional openings, for example, 24 and 26, of different diameters than opening 14. This embodiment allows a single locator plate to be utilized, as required, to support and locate more than one diameter of anchor bolt. In an additional modification shown in FIGS. 2 and 3, opening 28 is quite large and threaded, thus allowing it to receive bushing 30 having any opening 14 to secure any size or shape of work element. Either of these modifications, thus allows the maintenance of a smaller number of locator plates than would be required if each locator plate was capable of supporting only a single diameter or size of work element. In preferred embodiments nuts 56 and 58 are used to stabilize and secure threaded anchor bolt 17 to plate 8. However, it is within the teaching of the present invention to thread the openings in the plate and then securely thread work elements into the plate.

As shown, in preferred embodiments, the rails are angle irons because of the great strength to weight ratio that such rails provide. However, referring to FIG. 1, it is within the teaching of the present invention to utilize non-angled rails, such as straight rails 34 and 36 to support locator plate 37. Such non-angled rail elements may be all that is required in many systems, especially where the length of the rails is relatively short, and thus subject to limited load. It is also within the teaching of the present invention to utilize a single non-angled or T-cross-sectional rail to support plates on two sides.

The rails can be of any length, so long as they are capable of extending between or beyond bearing points. If necessary, they can be cut to length to fit within form walls. Where required, lift supports 38 and 40 can be used to raise the rails from the form. Securing elements, such as a plurality of nails 44 can be used to attach the rails to the forms.

As shown in FIG. 2, center lines 46, 48, and 50 may be scribed on plate 12 for each opening, and each rail may carry length indicia, such as the exemplary portions illustrated at 54, along their entire length for ease of locating plates at desired distances and spacing.

In operation, the present invention is utilized as follows. Initially, a form is provided to define the limits of the to-be-poured concrete. If required, supports for the element locators of the present invention, other than traditional forms, may be provided, although for the purposes of this specification, such supports are "forms". Now assuming, for example, that a piece of machinery, not shown, having three pre-drilled holes in its base plate is to be located on a concrete pad, a combination of the locator systems of the present invention, such as those illustrated in FIG. 1, may be utilized to locate three anchor bolts to mate with the pre-drilled holes in the machinery's base plate. Assuming that the distance and relationship between the holes is known, anchor bolts for any two of the holes in the machinery's base plate can be carried on a single pair of rails utilizing two locating plates. For example, a workman slides locating plate 8 along rail 4 to virtually any point along its length, and secures it with its screw. Then the workman can slide locating plate 10 along rail 4, and utilizing measuring means, precisely space locating plate 10 at a distance from locating plate 8 which distance corresponds to the distance between any two holes which are to be matched on the machinery. After locating plates 8 and 10 have been precisely placed on rail 4, and secured by the appropriate screws, then the workman slides rail 6 into the opposed slots of locating plates 8 and 10 and secures them with screws. Anchor bolts are then attached to each locating plate, for example, by first threading a nut 58 onto anchor bolt 17, inserting the bolt into locating plate 8 having an appropriately sized opening to match the diameter of the anchor bolt and then threading a second bolt 56 onto anchor bolt 17 to secure it to the plate. In preferred embodiments, nuts 56 and 58 are secured relatively tightly to the locating plate to minimize movement of anchor bolt 17 during the pouring of concrete.

Once the entire structure of system 2 is completed, it is placed on the form with the two anchor bolts in the position required within the form. Ruling instruments, measuring string or transits are utilized to precisely locate and orient the anchor bolts carried by system 2. In a similar manner, locating plate 37 is secured to rails 34 and 36 and then that entire system is located on the form with respect to locating plates 8 and 10 so as to provide the required location of the third anchor bolt. Again, locating plate 37 is positioned with respect to locating plate 8 and 10 by means of a ruler, measuring string, or transit. It may be noted, that in this entire operation, the only tool required is the screwdriver needed to secure the locating plates to the rails. If desired, a wrench may be utilized to tighten the nuts onto each anchor bolt and a hammer may be used to secure nails to hold the rails in place on the form.

After the system is thus arranged and located, the concrete, not shown, is poured to a depth to submerge at least a portion of the bottom of each anchor bolt. It will be noted that the system allows a great deal of space around the rails and locating plates to trowel or finish the surface of the poured concrete.

After the concrete has hardened to the point that it is capable of supporting the anchor bolts, the system is easily and conveniently removed. For example, all that is required is to remove the top nut from each anchor bolt and lift the locating system off of the anchor bolts. Subsequently the locating system of the present invention is easily disassembled by loosening each of the screws which attaches the locating plate to each rail, and removing the rails from the locating plates. Each element of the system is then cleaned and stored until required for subsequent use.

In preferred embodiments of the present invention, the center line of each hole is scribed on the locating plates, as shown in FIG. 2 at 46, 48 and 50 and each rail, or at least one rail in each pair of rails, will correspondingly be scribed with distance indicia 54. This modification allows a workman, upon locating the center line of any hole at any location along a marked rail to then precisely space the center line of a second, third, or more holes carried by a second, third or more locating plates at easily determined distances from the center line of the first hole and from one another, utilizing indicia 54 to provide information concerning the distance. This, thus allows the workman to forego the need for external rules, measures, or transits for locating elements on a pair of rails in a straight line. It also increases the accuracy of location, since the center lines of work elements, such as anchor bolts, are not marked, but the center line of the work elements will precisely coincide with the center lines scribed in precisely matched locating plates. Where a plurality of locating plates are used with a single pair of rails they, of course, are all of substantially the same width.

In the system illustrated, the rails are shown as resting on top of the form. However, the present invention encompasses those situations in which the depth or size or shape of the form will not allow the locating system to bear on top of the form. In such systems, it is within the skill of the art to fit the locating systems of the present invention inside of the form, bearing on points in the form which are secured to the inside or bottom of the form, such as nails, screws, or blocks. In those instances in which the system must be located within the form, it may be necessary to cut the rails to length to accomodate the dimensions of the form.

The locator plates of the present invention may be formed of any relatively rigid material, including polymers, pressboard, wood, metal, and others. High density polyethylene is preferred. The rails are preferably of a rigid, strong material and will normally be made of steel or other suitable metal. In most systems, the locator plates will be rectalinear, with, for example, slots on opposed sides of the plate. However, other plate shapes, including non-rectalinear parallelograms, or other polygons having at least two parallel opposed sides may be utilized. It is even conceivable, within the teaching of the present invention, that special keying shapes or sides may be provided to couple with complimentary keyed rails. In a similar manner, of course, special keying rails may be provided for keyed plates.

While the locating plates have been shown as attached to the rails by means of slots and screws, other means of support and attachment are within the teaching of the present invention. For example, locator plates may be lipped on only one side and caused to rest upon the rails. In a similar manner, locator plates may be attached to the rails by means of clamps, nuts, or tapped holes which overlay holes in the rails. In yet other embodiments, the locating plates may be secured to the rails simply by friction fit. Regardless of the specific shape of the locator element, the rail, or the means of attaching the locating elements to the rails, the basic teaching of the present invention requires only that a pair of rails and a locating plate be provided to locate a work element within a form at any position within that form.

As used herein, the term "form" is intended to include any pair of elements which define a support surface for the locator system of the present invention. It may include the classical wooden, paper, masonary, paper, metal or fiberglass form which entirely encloses a pour area, or it may include only a pair of support elements or blocks which are located with respect to a pour, perhaps for the sole purpose of supporting the system of the present invention.

While the present invention has been described substantially with respect to its use in concrete work, it is within the skill of the art to utilize the locating system of the present invention for locating elements to be set in any poured composition, for example, cement, asphalt, plaster, lime, polymeric material, or the like.

Although the invention has been particularly described and shown with reference to preferred embodiments therein, it will be understood by those skilled in the art that the foregoing and other changes in form and detail may be made therein without departing from the spirit and scope of the invention.

What is claimed is:

1. A reusable element locator system for accurately positioning a work element to-be-embedded in a to-be-set composition within a form, said system comprising:

a first rail;

a second rail, said second rail spaced from and substantially parallel to said first rail; and means for holding a work element within a form, said holding means having first and second substantially parallel opposed sides, said first opposed side supported by said first rail and said second opposed side supported by said second rail, said holding means being adjustable for support anywhere along the length of said first and said second rails, whereby said holding means is located for support by said first and second rails and said rails are positioned for support by a form so that said holding means, and any to-be-embedded work element held by said holding means in a to-be-set composition are accurately positioned at a predetermined location within a form.

2. The system of claim 1 wherein said opposed sides of said holding means include flanges for support by said rails.

3. The system of claim 1 wherein said holding means is secured to said rails by attaching means extending into said holding means and into contact with said rails.

4. The system of claim 1 wherein said first and second opposed sides of said holding means include slots in which said rails reside.

5. The system of claim 4 wherein said holding means is secured to said rails by attaching means extending through said holding means into said slots and into contact with said rails.

6. The system of claim 5 wherein said attaching means are screws.

7. The system of claim 1 wherein said holding means define an opening for receiving and holding a work element.

8. The system of claim 1 wherein said holding means defines a plurality of openings for receiving and holding a work element.

9. The system of claim 8 wherein each of said openings is of a different size or shape.

10. The system of claim 7 wherein said opening is circular and threaded.

11. The system of claim 10 wherein a cylindrical bushing including an opening and a threaded external surface is in threaded support and contact with said threaded circular opening of said holding means.

12. The system of claim 7 wherein said holding means includes indicia of the center of said opening.

13. The system of claim 7 wherein at least one of said rails includes distance indicia.

14. The system of claim 1 wherein said system includes more than one means for holding a work element, each of said holding means being substantially the same width and having first and second opposed sides supported, respectively, by said first and second rails, whereby each of said holding means are positioned along said rails at a distance from one another.

15. The system of claim 14 wherein more than one of said holding means defines an opening and includes indicia of the center of said opening, and at least one of said rails includes distance indicia.

16. The system of claim 1 wherein at least one of said rails has an L-shaped cross-section.

17. Means for holding a work element including a plate, said plate having first and second substantially parallel opposed sides, each of said first and second opposed sides including slots, and means extending through said holding means into said slots for securing said holding means to an object residing in said slots.

18. The holding means of claim 17 wherein said holding means define an opening for receiving and holding a work element.

19. The holding means of claim 18, including indicia of the center of said opening.

* * * * *